US005514929A

United States Patent [19]

Kawamura

[11] Patent Number: 5,514,929

[45] Date of Patent: May 7, 1996

[54] SPARK PLUG INCLUDING A GROUND ELECTRODE, A CENTER ELECTRODE, AND A RESISTOR

[75] Inventor: Kazumi Kawamura, Nagoya, Japan

[73] Assignee: NGK Spark Plug Co., Ltd., Nagoya, Japan

[21] Appl. No.: 253,311

[22] Filed: Jun. 3, 1994

[30] Foreign Application Priority Data

Aug. 4, 1993 [JP] Japan ..... 5-192650

[51] Int. Cl.[6] ..... H01T 13/20

[52] U.S. Cl. ..... 313/141; 313/136

[58] Field of Search ..... 313/141, 142, 313/136

[56] References Cited

U.S. PATENT DOCUMENTS

| | | | |
|---|---|---|---|
| 3,737,718 | 6/1973 | Rempes et al. | 313/136 |
| 3,909,459 | 9/1975 | Friese et al. | 252/509 |
| 4,029,990 | 6/1977 | Nagy et al. | 313/124 |
| 4,331,899 | 5/1982 | Nishida et al. | 313/141 |
| 4,465,952 | 8/1984 | Sato et al. | 313/141 |
| 4,540,910 | 9/1985 | Kondo et al. | 313/141 |
| 4,581,558 | 4/1986 | Takamura et al. | 313/141 |
| 4,670,684 | 6/1987 | Kagawa et al. | 313/141 |
| 4,699,600 | 10/1987 | Kondo | 445/7 |
| 4,700,103 | 10/1987 | Yamaguchi et al. | 313/141 |
| 4,845,400 | 7/1989 | Takamura et al. | 313/141 |
| 4,893,051 | 1/1990 | Kondo | 313/141 |
| 5,017,826 | 5/1991 | Oshima et al. | 313/141 |
| 5,101,135 | 3/1992 | Oshima | 313/142 |
| 5,304,894 | 4/1994 | Stimson | 313/118 |
| 5,347,193 | 9/1994 | Oshima et al. | 313/142 |

*Primary Examiner*—Sandra L. O'Shea
*Assistant Examiner*—Vip Patel
*Attorney, Agent, or Firm*—Sughrue, Mion, Zinn, Macpeak & Seas

[57] ABSTRACT

In a spark plug for a gas engine including a ground electrode (4) whose front end is to be placed in a combustion chamber of a gas engine which is driven by gaseous fuel, a metallic shell (3) enclosing a center electrode (5) which has a noble metal tip (18) superior in spark-erosion resistance at a firing portion in which a spark discharge occurs against the ground electrode (4). A resistor (10) is provided within the spark plug or a spark plug cap so as to be included in a spark plug voltage circuit which applies a high voltage to the center electrode. It is preferable that the noble metal tip (18) has a diameter in a range of 0.5~1.5 mm, and that the resistor has an electrical resistance greater than or equal to 50 kΩ.

5 Claims, 6 Drawing Sheets

SPARK PLUG INCLUDING A GROUND ELECTRODE, A CENTER ELECTRODE, AND A RESISTOR

BACKGROUND OF THE INVENTION

1. Field of the Invention

This invention relates to a spark plug for a gas engine which is driven by gaseous fuel such as natural gas, city gas, liquefied petroleum gas or the like.

2. Description of Prior Art

In a spark plug for a gas engine which is driven by gaseous fuel such as natural gas, city gas, liquefied petroleum gas or the like, it has been used as a driving means for an air-conditioner, an electrical generator and the like. In this type of gas engine, it has been demanded to prolong its endurance (service life) for a long consecutive operation and an extended intervals between maintenance working.

It, however, requires a high voltage for a spark discharge to occur across a center and a ground electrode due to its high compression pressure and gaseous fuel used for the gas engine. This causes the temperature of the center electrode to excessively rise so as to spark erode a firing end of the center electrode due to its intensified oxidation. In order to prolong the service life of the spark plug for the gas engine, it has been necessary to narrow a spark gap between the electrodes so as to drop the required discharge voltage therebetween while providing a noble metal tip on the firing end of the center electrode.

Simply narrowing the spark gap worsens an ignitibility due to a flame extinguishing effect. Merely thinning the noble metal tip diametrically in order to improve the ignitibility causes its temperature to extraordinarily rises due to concentration of spark discharge energy, and thus spark eroding the noble metal tip because of the intensified oxidation.

On the other hand, when a platinum tip is employed with the spark gap narrowed, the metal grains deposit (sweating) successively on a discharge surface of the tip with the repetition of the spark discharge owing to spark discharge energy and combustion gas of high temperature. Further repetition of the spark discharge grows the grains to bridge the narrowed spark gap.

Therefore, it is an object of the invention to provide a spark plug for a gas engine which is capable of prolonging a service life without losing a good ignitibility against gaseous fuel, and at the same time, controlling the spark discharge energy to avoid the spark erosion of the noble metal tip due to an oxidation-based evaporation.

It is another object of the invention to provide a spark plug for a gas engine which is capable of preventing the bridging of the spark gap so as to avoid the occurrences of inadvertent misfire when the spark gap is adapted to be narrowed.

SUMMARY OF THE INVENTION

According to the invention, there is provided a spark plug for a gas engine including a ground electrode whose front end is to be placed in a combustion chamber of a gas engine which is driven by gaseous fuel, a center electrode having a noble metal tip superior in spark-erosion resistance at a firing portion in which a spark discharge occurs against the ground electrode, and a resistor provided in a spark plug voltage circuit which applies a high voltage to the center electrode. A diameter of the noble metal tip is in a range of 0.5~ 1.5 mm, and the resistor in the spark plug voltage circuit is equal to 50 kΩ or greater than 50 kΩ.

With the diameter of the noble metal tip is in a range of 0.5~1.5 mm, and with the resistor equal to 50 kΩ or greater than 50 kΩ, it is possible to prevent an excessive temperature rise of the tip by controlling an inductive energy for the spark discharge, and thus significantly reducing the oxidation-based evaporation and the spark erosion of the tip so as to contribute to a long service life without losing the good ignitibility against the gaseous fuel.

With the noble metal tip made of corrosion- and oxidation-resistant iridium or iridium-based alloy, it is possible to control the noble metal molecules from microscopically melting (dispersing) away the discharge surface of the tip owing to spark discharge energy and high temperature combustion gas because a melting point of iridium is higher than that of platinum by 700° K. with less oxidation-based evaporation. This effectively controls the development and growth of the metal grains on the discharge surface of the tip so as to prevent the spark gap from being bridged. For this reason, iridium or iridium-based alloy is best-suited for the noble metal tip which is placed on the firing portion of the center electrode in a spark plug for a gas engine.

These and other objects and advantages of the invention will be apparent upon reference to the following specification, attendant claims and drawings.

DETAILED DESCRIPTION OF THE EMBODIMENT OF THE INVENTION

Figure 1:
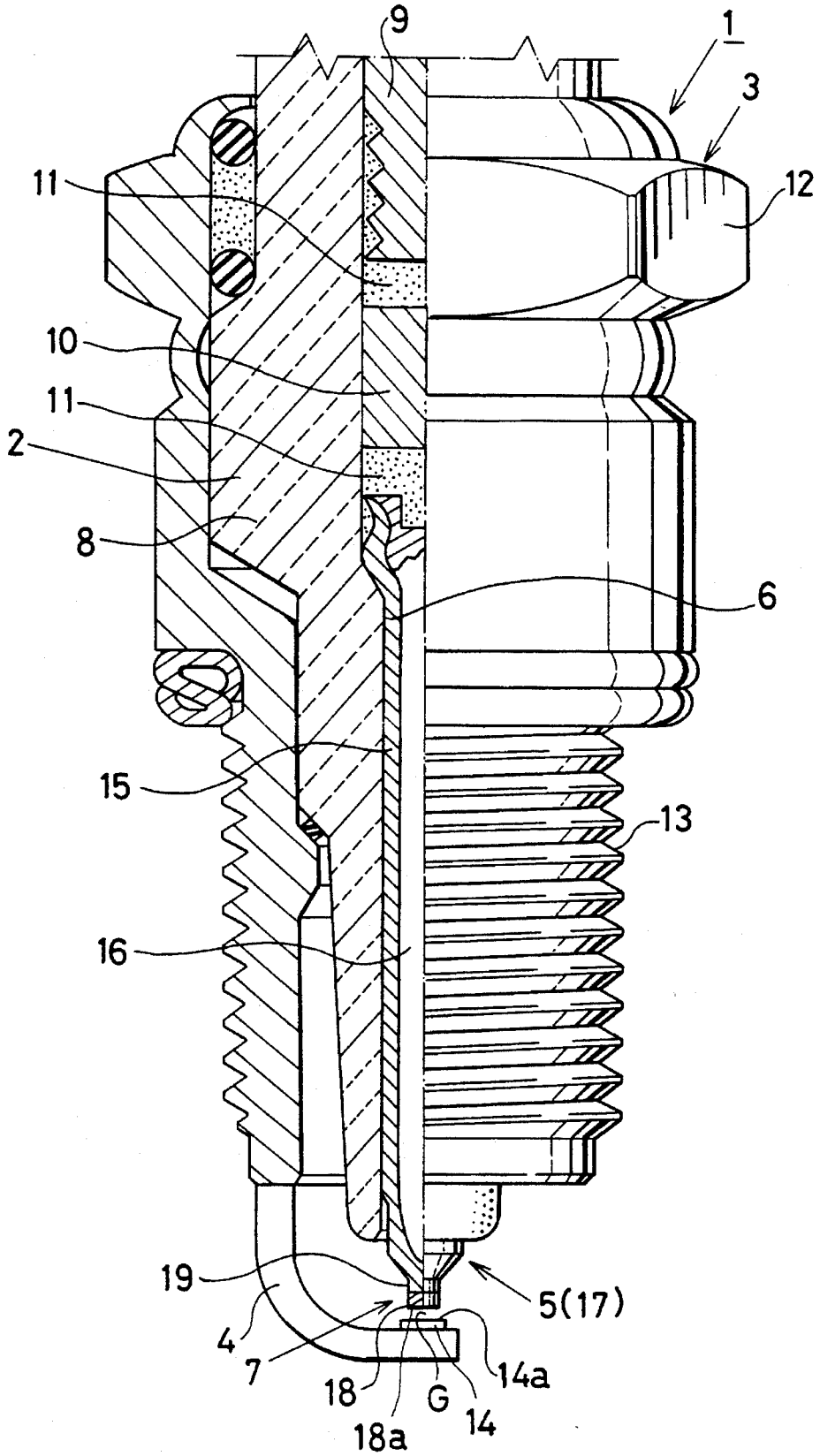
FIG. 1 is a half-sectioned view of a main portion of a spark plug for a gas engine according to a first embodiment of the invention.

Referring to FIG. 1 which shows a main portion of a spark plug 1 for a gas engine according to a first embodiment of the invention, the resistor type spark plug 1 is provided to drive a compressor of a gas-actuated heat pump (air-conditioner) in the gas engine (not shown). The spark plug 1 has a metallic shell 3 in which a tubular insulator 2 is placed. To a lower end of the metallic shell 3, a ground electrode 4 is secured by means of welding or the like so as to form a spark gap (G) with a front end of a center electrode 5. The insulator 2 is made of a ceramic body sintered with aluminum oxide or aluminum nitride as a main component. The double open-ended insulator 2 has an inner space to serve as an axial bore 6. In a lower half of the axial bore 6, the center electrode 5 is concentrically placed whose front end is slightly extended beyond the insulator 2 at the side of a firing portion. In an upper half of the axial bore 6, a terminal electrode 9, a resistor 10, and an electrically conductive vitreous layer 11 are placed in turn from a middle barrel portion 8 of the insulator 2 toward an rear end of the axial bore 6.

The metallic shell 3 constitutes an outer contour of the spark plug 1 to support the insulator 2, and at the same time, serving as a means through which the spark plug 1 is mounted on a cylinder head of the gas engine.

An upper portion of the metallic shell 3 has a hexagonal nut portion 12 which is used by a tool such as a wrench or the like, while a lower portion of the metallic shell 3 has a male thread 13 to mount it on the gas engine.

The ground electrode 4 is made of nickel-based alloy such as Ni—Cr, Ni—Mn—Si, Ni—Cr—Fe (Inconel) or the like which are all superior in heat—and corrosion-resistant property. The ground electrode 4 is bent into an L-shaped configuration, and placed to oppose a front end of the center electrode 5. To a discharge surface of the ground electrode 4, a spark-erosion resistant noble metal (Pt) or P t—Ni, Pt—Ir alloy tip 14 is secured by means of electric resistance welding, laser beam welding or the like.

Meanwhile, the center electrode 5 forms a composite electrode column 17 made by a clad metal 15 and a core 16 embedded in the clad metal 15. The clad metal 15 is made of nickel-based alloy such as Ni—Cr, Ni—Mn—Si, Ni—Cr—Fe (Inconel) or the like which are all superior in heat—and corrosion-resistant property. The core 16 is made of heat-conductive copper or copper-based alloy superior in heat conductivity. A front end of the clad metal 15 of the composite electrode column 1 7 is constricted at the firing portion 7 to form a diameter-reduced neck portion 19. On a front end surface of the diameter-reduced neck portion 19, a noble metal tip 18 is placed by means of electric resistance welding, laser beam welding or the like. The noble metal tip 18 is formed into a columnar configuration, by an inexpensive iridium (Ir) or iridium-platinum alloy because melting points of these metals are higher than platinum by approx. 700° K. with less spark-erosion, corrosion and oxidation-based evaporation.

Figure 2:
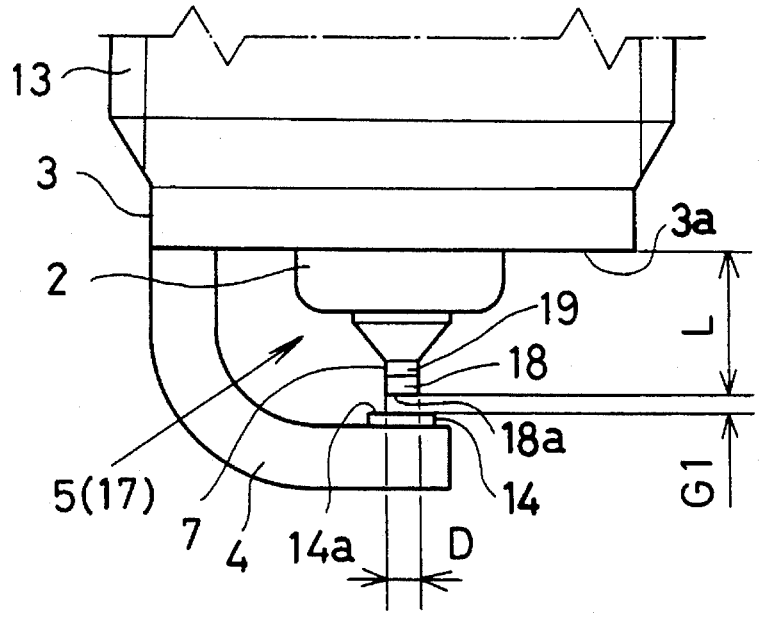
FIG. 2 is a side elevational view of a firing portion of the spark plug.

A diameter (D) of the noble metal tip 18 is in a range of 0.5~1.5 mm according to a specification of the gas engine and a type of the gaseous fuel used for the gas engine. The diameter (D) of the noble metal tip 18 is preferably in the range of 0.8~1.0 mm. A diameter of the diameter-reduced neck portion 19 is in accordance with the diameter (D) of the tip 18. As shown in FIG. 2, a distance interval (G1), i.e., the spark gap (G) between a discharge surface 18*a* of the noble metal tip 18 and a discharge surface 14*a* of the tip 14 of the ground electrode 4 is in a range of 0.3~0.5 mm according to the specification of the gas engine and a type of the gaseous fuel used for the gas engine. A distance (L) between a front end 3*a* of the metallic shell 3 and the discharge surface 18*a* of the noble metal tip 18 is in a range of 1.5~5.5 mm, and preferably aprox. 3.5 mm.

Figure 8:
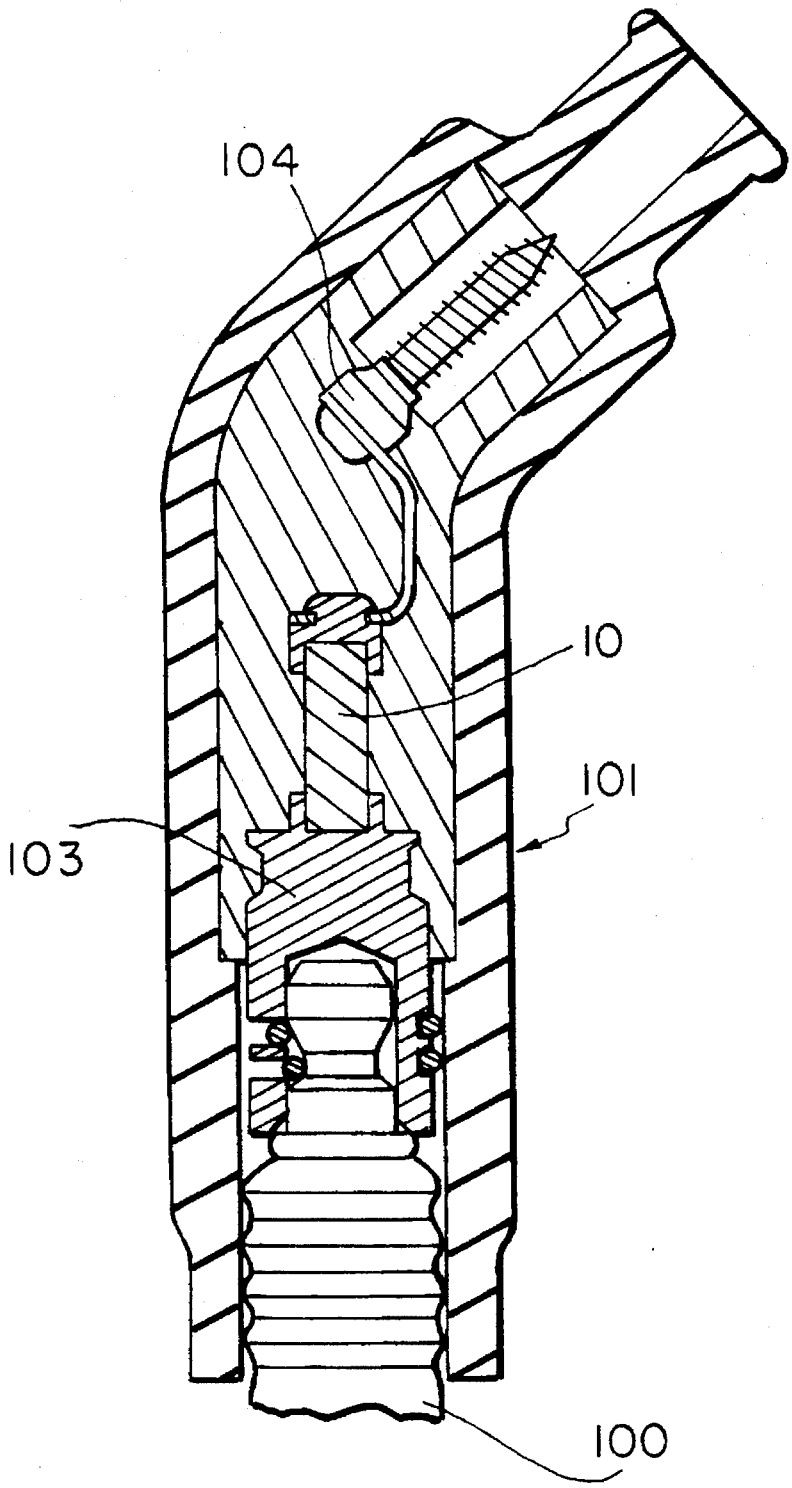
FIG. 8 is a sectional view of an alternative embodiment of the spark plug according to present invention.

In the meantime, an electrical resistance of the resistor 10 is in a range of 50~200 kΩ, and preferably in the range of 100~200 kΩ. The resistor 10 is formed into a columnar configuration from glass powder—, ceramic powder—, and carbon black-based material such as boron silicic lithium calcium glass, zirconia, carbon black or the like. The resistor 10 is electrically connected between the center electrode 5 and the terminal electrode 9 in an ignition coil of the spark plug voltage circuit. In this instance, the resistor may be provided in a spark plug cap as shown in FIG. 8. FIG. 8 illustrates spark plug cap 101 fitted on spark plug 100. Resistor 10 is positioned between plug terminal 103 and cord terminal 104.

The spark plug 1 is manufactured as follows:

(i) After completing the composite electrode column 17 by embedding the core 16 in the clad metal 15, the composite electrode column 17 is appropriately formed by means of plastic working or cutting procedure.

(ii) Then, the diameter-reduced neck portion 19 is provided on the firing portion 7 of the composite electrode column 17. To the front end surface of the neck portion 19, the noble metal tip 18 is welded to form the center electrode 5.

(iii) To the axial bore 6 of the insulator 2, the center electrode 5 is inserted, and the insulator 2 is loaded with the electrically conductive vitreous powder. Then, the resistor 10 is placed in the insulator 2 which is further loaded with the electrically conductive vitreous powder. The terminal electrode 9 is press-fit at high temperature in the insulator 2 to melt the electrically conductive vitreous powder between a rear end of the center electrode 5 and terminal electrode 9, and thus forming the electrically conductive vitreous layer 11 to hermetically seal a connection between a rear end of the center electrode 5 and terminal electrode 9.

(iv) The insulator 2 is placed in the metallic shell 3 to which the ground electrode 4 is welded so as to provide the spark plug 1.

The spark plug 1 is mounted on the gas engine, and a high voltage is intermittently applied to the center electrode 5 from a secondary coil of the ignition coil. Then, repetitive spark discharge occurs at the spark gap (G) between the discharge surface 18a of the noble metal tip 18 and the discharge surface 14a of the tip 14 of the ground electrode 4.

In an instance when a platinum tip is employed with the spark gap narrowed, the metal grains deposit (sweating) successively on a discharge surface of the tip with the repetition of the spark discharge owing to spark discharge energy and combustion gas at high temperature. Further repetition of the spark discharge grows the noble metal grains against the ground electrode so as to bridge the narrowed spark gap of 0.3~0.5 mm, thus causing inadvertent misfire occurrences inadvertent.

On the contrary, with the use of the noble metal tip 18 whose diameter (D) is in the range of 0.5~1.5 mm, and whose iridium-based alloy having a melting temperature higher than platinum by approx. 700° K. with less corrosion, oxidation, oxidation-based evaporation and spark erosion, it is possible to control the noble metal molecules from microscopically melting (dispersing) away the discharge surface of the tip owing to spark discharge energy and combustion gas of high temperature. This also prevents the spark gap (G) from being bridged when the spark gap is narrowed to such an extent that it is in the range of 0.3~0.5 mm.

When the spark plug is mounted on the gas engine for the gas-driven heat pump (1.1 liter) with the distance interval (G1) of the spark gap (G) and the diameter (D) of the tip 18 as 0.5 mm and 1.0 mm, the spark-erosion and oxidation resistant property are investigated by changing the electrical resistance of the resistor 10 while operating the gas engine at 2200 rpm with no load.

Figure 3:
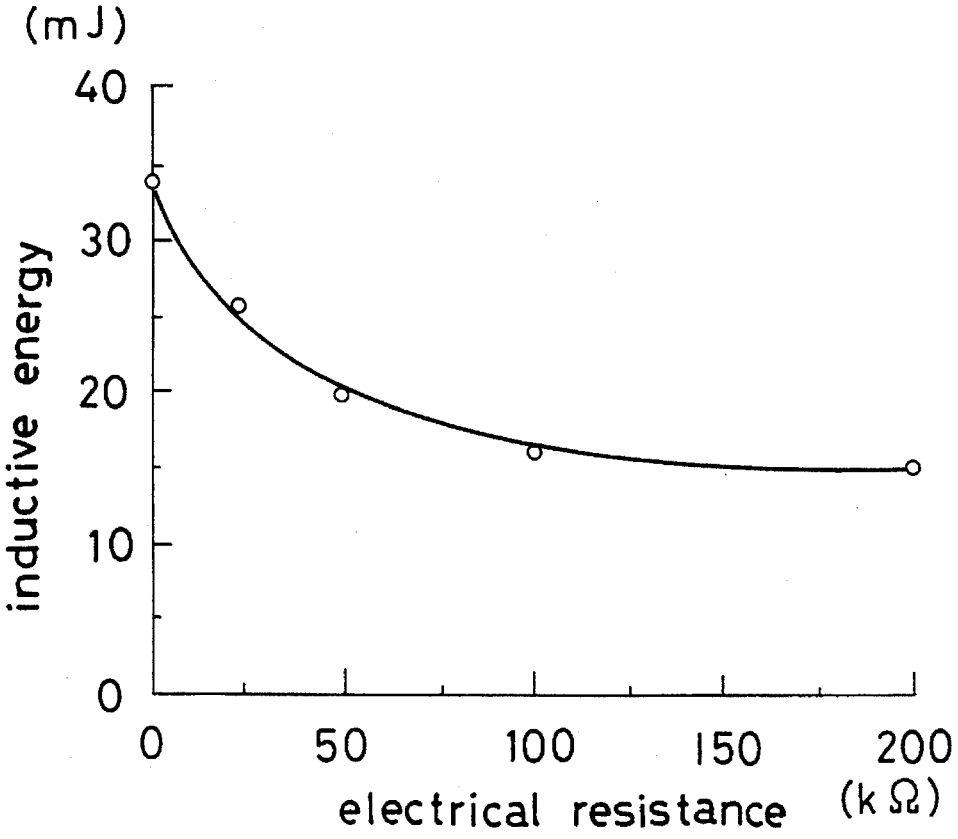
FIG. 3 is a graph showing a relationship between an inductive energy (mJ) and an electrical resistance (kΩ) of a resistor.

The investigation results are shown in FIG. 3. When the electrical resistance of the resistor 10 reaches 50 kΩ, the inductive energy required to cause the spark discharge is less than 20 mJ to indicate that the spark-erosion and oxidation resistant property is improved. When the electrical resistance of the resistor 10 is in the range of 100~200 kΩ, the inductive energy reaches a minimum, and substantially remains unchanged with the further increase of the electrical resistance.

Accordingly, when the electrical resistance of the resistor 10 is 100 kΩ, it is possible to maintain the temperature of the tip 18 low since the inductive energy is controlled about 15 mJ. This makes it possible to prevent an excessive temperature rise of the tip 18, and thus effectively controlling the oxidation-based evaporation and spark erosion of the noble metal tip 18 so as to significantly improve the endurance of the spark plug.

An experimental test is carried out by mounting the resistor type spark plug (specimens 1~3) on the gas engine for the gas-driven heat pump (1.1 liter) with the distance interval (G1) of the spark gap (G) as 0.5 mm, the ignitibility is investigated in terms of critical air-fuel ratio by changing the diameter (D) of the noble metal tip 18 while operating the gas engine at 2200 rpm with no load.

Figure 4:
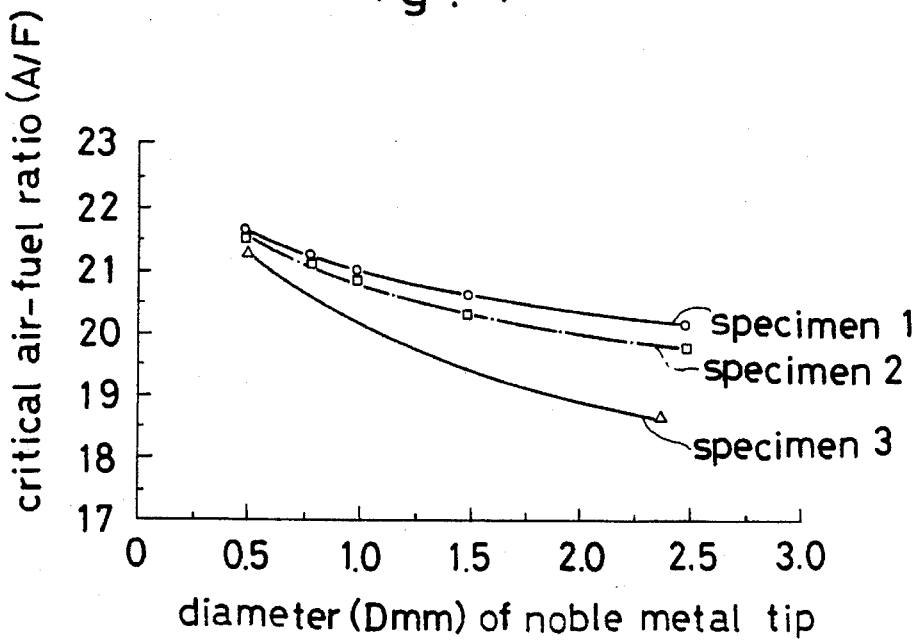
FIG. 4 is a graph showing a relationship between a critical air-fuel ratio (A/F) and a diameter (D mm) of a noble metal tip.

The experimental test results are shown in FIG. 4 in which a full transistor type ignition device is used in the specimens 1 and 2 with the inductive energy as 35 mJ and 15 mJ, while a capacity-discharge type ignition device (CDI) is used in the specimen 3 with the inductive energy as 5 mJ. A common resistor (5 kΩ) is used in the specimens 1~3 of the spark plug.

As apparent from the results of FIG. 4, no significant difference between the specimens 1~3 is perceived in ignitibility when the diameter (D) of the noble metal tip 18 is 0.5 mm. In the specimen 3, it is found that the ignitibility worsens with the increase of the diameter (D). Regarding to the ignitibility, the specimen 2 substantially follows the specimen 1 without significant drop of the air-fuel ratio irrespective of the increase of the diameter (D). As a consequence, it is possible to maintain the good ignitibility against the gaseous fuel by using the resistor 10 of 100~200 kΩ and controlling the inductive energy under 15 mJ (referred again to FIG. 3).

Figure 5:
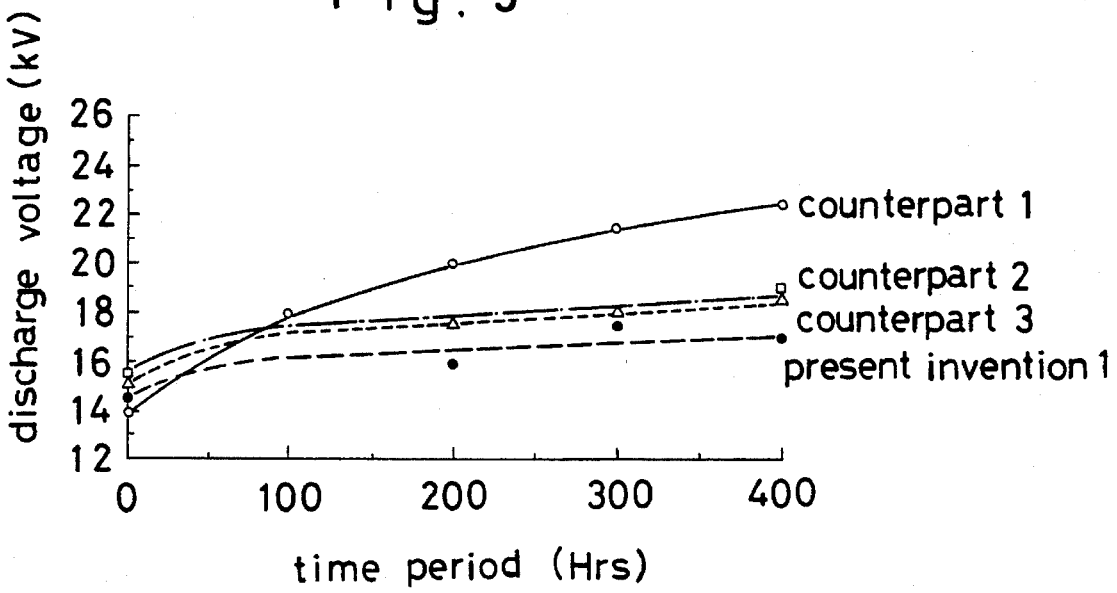
FIG. 5 is a graph showing a relationship between a spark discharge voltage (kV) and an endurance time period (Hr)

Another experimental test is carried out by using spark plugs corresponding to counterparts 1~3 and the present invention which are in turn mounted on the gas engine. The discharge voltage (kV) required for the spark plug to spark is measured every 100 hours about the counterparts 1~3 and the present invention 1. The experimental test results are shown in FIG. 5 in which the experimental test is evaluated under the pressure of 0.784 MPa with 60 Hz as an ignition cycle. In the counterparts 1 and 2, the resistor type spark plug is used in which the noble metal tip is made of Pt—Ir alloy and in turn measures 2.5 mm and 1.0 mm in diameter (D). In both the counterpart 3 and the present invention 1, the resistor type spark plug is used in which the noble metal tip is made of iridium (Ir) and measures 0.8 mm in diameter (D). In the counterparts 1~3, the electrical resistance of the resistor is 5 kΩ, while the resistor 10 used in the present invention 1 is 100 kΩ.

As understood from FIG. 5, the discharge voltage increases with the elapse of time because the noble metal tip (D=ϕ2.5) is relatively thick in the counterpart 1. This is because the spark gap (G) is widened due to the spark erosion. In the counterparts 2, 3, the discharge voltage does not increase significantly with the elapse of time because the noble metal tip (D=ϕ1.0 mm, 0.8 mm) is relatively thin. In the present invention 1, the discharge voltage is minimum because the noble metal tip (D=ϕ0.8 mm) is relatively thin with the resistor 10 as 100 kΩ. This is because the spark gap (G) is not be widen due to the spark erosion under the better control, which naturally improves the ignitibility against the gaseous fuel.

Figure 6:
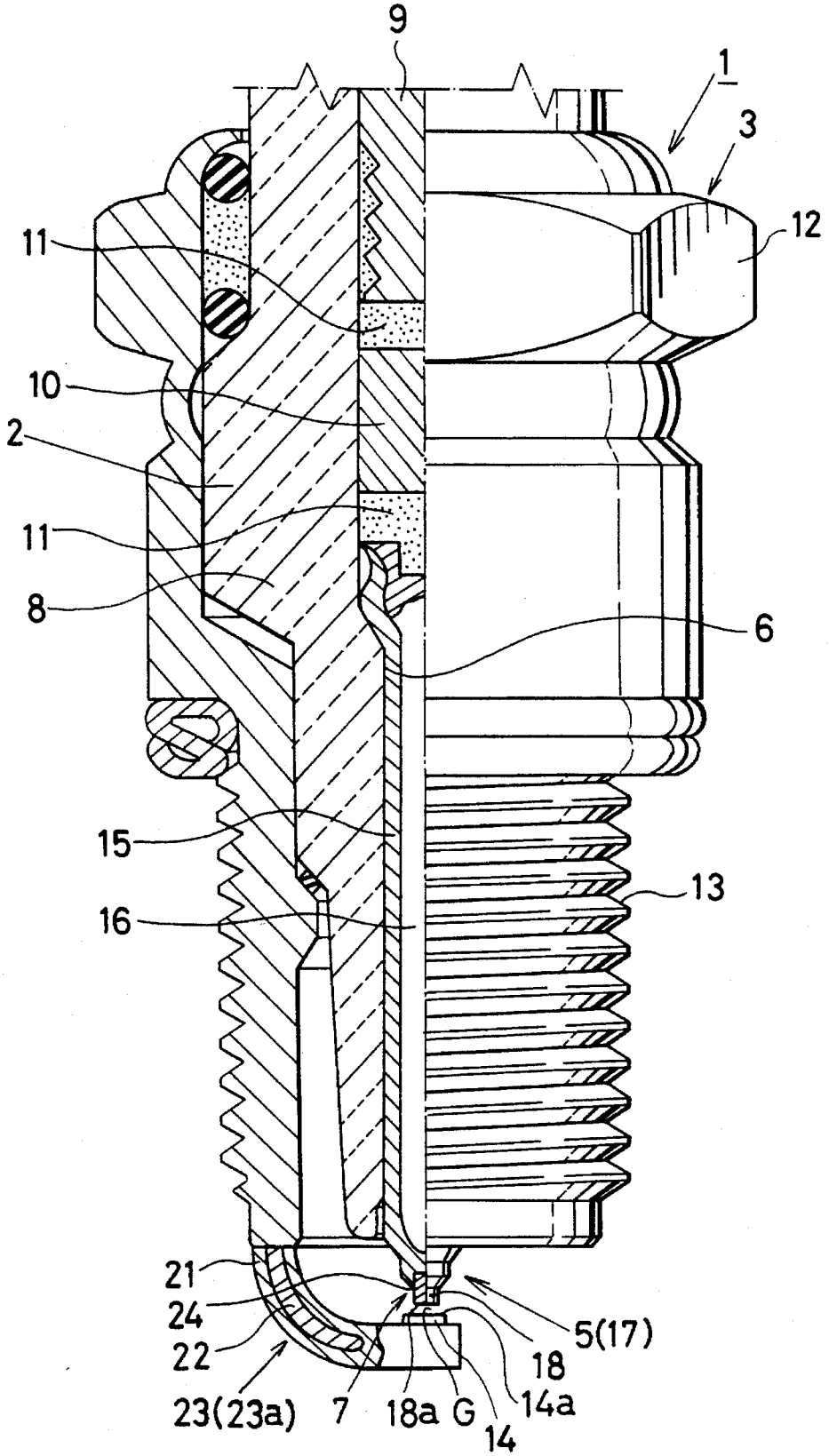
FIG. 6 is a half-sectioned view of a main portion of a spark plug for a gas engine according to a second embodiment of the invention.
Figure 7:
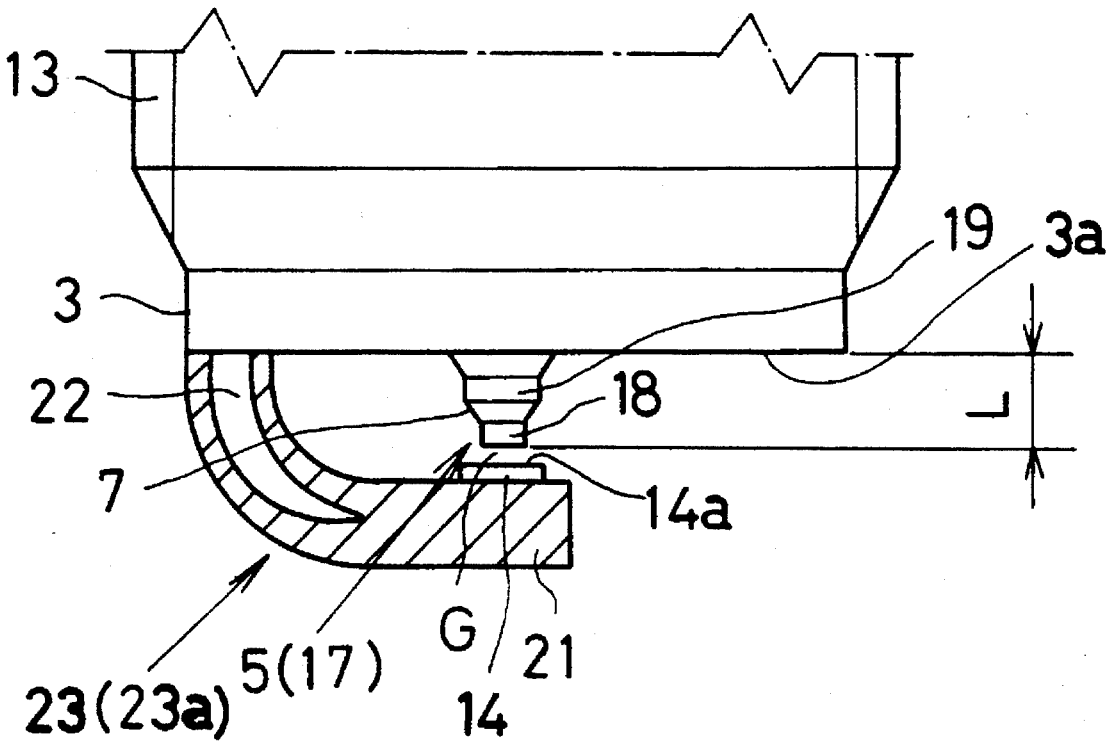
FIG. 7 is a side elevational view of a firing portion of the spark plug.

FIGS. 6, 7 show a second embodiment of the invention which is particularly suitable for a gas engine whose combustion chamber is exposed to high temperature. In this embodiment of the invention, a ground electrode 23 includes a composite electrode column 23*a* in which a copper core 22 is embedded in a clad metal 21 so as to improve a heat-drawing effect. On the clad metal 15 of the center electrode 5, a cavity 24 is provided in correspondence to the firing portion 7. The noble metal tip 18 is fitted in the cavity 24 with its discharge surface 18*a* slightly extended upside beyond a front end surface of the center electrode 5. Then, the noble metal tip 18 is solidly secured to the clad metal 21 of the center electrode 5 by means of electric resistance welding, laser beam welding or the like. In this instance, the distance (L) between the front end 3*a* of the metallic shell 3 and the discharge surface 18*a* of the noble metal tip 18 is approx. 1.5 mm in order not to be exposed to the high temperature environment inside the combustion chamber of the gas engine. This also makes it possible to obviate an oxidation against the ground electrode 4 and the center electrode 5 in the high temperature environment.

It is appreciated that the noble metal tip may be made of gold, palladium, rhodium or ruthenium instead of iridium or iridium-based alloy.

It is also appreciated that the noble metal tip may be made of iridium-based alloy such as an alloy of iridium and oxide of rare earth metal (yttrium, lanthanum) or the like, otherwise the tip may be made of ruthenium-based alloy such as an alloy of ruthenium and oxide of rare earth metal (yttrium, lanthanum) or the like.

While the invention has been described with reference to the specific embodiments, it is understood that this description is not to be construed in a limiting sense in as much as various modifications and additions to the specific embodiments may be made by skilled artisans without departing from the spirit and scope of the invention.

What is claimed is:

1. A spark plug for a gas engine, said spark plug including a ground electrode (4) whose front end is to be placed in a combustion chamber of the gas engine which is driven by gaseous fuel, a metallic shell (3) enclosing a center electrode (5) which has a noble metal tip (18) superior in spark-erosion resistance at a firing portion in which a spark discharge occurs against the ground electrode (4), and a resistor (10) provided within one of the spark plug and a spark plug cap so as to be included in a spark plug voltage circuit which applies a high voltage to the center electrode;

the noble metal tip having a diameter in a range of 0.5~1.5 mm, and the resistor having an electrical resistance in the range of 50–200 kΩ;

wherein the metallic shell (3) has a front end (3*a*), a distance (L) between said front end (3*a*) and a discharge surface (18*a*) of the noble metal tip (18) is from 1.5 mm to 5.5 mm, while the ground electrode (4) has a noble metal tip (14) provided thereon to form a spark gap (G) between a discharge surface (14*a*) of the noble metal tip (14) and the discharge surface (18*a*) of the noble metal tip (18), the spark gap (G) being from 0.3 mm to 0.5 mm.

2. The spark plug for a gas engine according to claim 1, wherein the noble metal tip is made of a noble metal or a noble metal alloy superior in corrosion- and oxidation-resistance.

3. The spark plug for a gas engine according to claim 1, wherein the noble metal tip is made of iridium or iridium-based alloy.

4. The spark plug for a gas engine according to claim 1, wherein the noble metal tip is made of a noble metal selected from the group consisting of gold, palladium, rhodium and ruthenium.

5. The spark plug for a gas engine according to claim 1, wherein the noble metal tip is made of an alloy of iridium and oxide of rate earth metal, or an alloy of ruthenium and oxide of rare earth metal.

* * * * *